US010746440B2

(12) United States Patent
Donovan et al.

(10) Patent No.: US 10,746,440 B2
(45) Date of Patent: Aug. 18, 2020

(54) THERMAL MANAGEMENT SYSTEM INCLUDING TWO-PHASED PUMP LOOP AND THERMAL ENERGY STORAGE

(71) Applicants: Rolls-Royce North American Technologies, Inc., Indianapolis, IN (US); Rolls-Royce Corporation, Indianapolis, IN (US)

(72) Inventors: Eric S. Donovan, Fishers, IN (US); Michael J. Head, Mooresville, IN (US); Ken S. Rubel, Indianapolis, IN (US); Brian T. Spangler, Avon, IN (US); Douglas J. Snyder, Carmel, IN (US); Aric Acius, Avon, IN (US)

(73) Assignees: ROLLS-ROYCE NORTH AMERICAN TECHNOLOGIES, INC., Indianapolis, IN (US); ROLLS-ROYCE CORPORATION, Indianapolis, IN (US)

( * ) Notice: Subject to any disclaimer, the term of this patent is extended or adjusted under 35 U.S.C. 154(b) by 134 days.

(21) Appl. No.: 16/058,224

(22) Filed: Aug. 8, 2018

(65) Prior Publication Data

US 2019/0316817 A1 Oct. 17, 2019

Related U.S. Application Data

(60) Provisional application No. 62/656,518, filed on Apr. 12, 2018.

(51) Int. Cl.
*F25B 23/00* (2006.01)

(52) U.S. Cl.
CPC ..... *F25B 23/00* (2013.01); *F25B 2600/13* (2013.01); *F25B 2600/2501* (2013.01)

(58) Field of Classification Search
CPC ..... F25B 23/00; F25B 25/005; F25B 40/00; F25B 9/008; F25B 23/006;
(Continued)

(56) References Cited

U.S. PATENT DOCUMENTS 6,948,556 B1 9/2005 Anderson et al.
10,184,699 B2 * 1/2019 Shedd ..... F25B 23/006
(Continued)

FOREIGN PATENT DOCUMENTS

WO 2005116547 A1 12/2005

*Primary Examiner* — Ana M Vazquez
(74) *Attorney, Agent, or Firm* — Brinks Gilson & Lione

(57) ABSTRACT

A thermal management system for regulating dissipation of multiple thermal loads during operation of an apparatus includes a two-phase pump loop (TPPL), a vapor cycle system (VCS), and a liquid thermal energy storage (TES) system integrated together to maintain the apparatus at a constant temperature. The TPPL is configured to remove heat from the apparatus; the TES system is configured to provide thermal energy storage and temperature regulation; and the VCS is configured to transfer heat to the environment. The multiple thermal loads include a primary thermal load in the form of heat from the apparatus and a secondary thermal load in the form of at least one of a housekeeping thermal load or a power electronics thermal load. The primary and secondary loads are at different temperatures with each being independently selected to be transient or steady state.

19 Claims, 7 Drawing Sheets

(58) Field of Classification Search
CPC ..... F25B 2341/0011; F25B 2400/24; F25B 2400/03; F25B 2309/061
See application file for complete search history.

(56) References Cited

U.S. PATENT DOCUMENTS

| | | | | |
|---|---|---|---|---|
| 2003/0029179 | A1* | 2/2003 | Vander Woude .. | B60H 1/00014 62/201 |
| 2006/0070385 | A1 | 4/2006 | Narayanamurthy et al. | |
| 2009/0133412 | A1 | 5/2009 | Narayanamurthy et al. | |
| 2009/0293507 | A1 | 12/2009 | Narayanamurthy et al. | |

* cited by examiner

THERMAL MANAGEMENT SYSTEM INCLUDING TWO-PHASED PUMP LOOP AND THERMAL ENERGY STORAGE

CROSS-REFERENCE TO RELATED APPLICATIONS

This application claims priority to U.S. Provisional Application No. 62/656,518 filed Apr. 12, 2018, the entire content of which is incorporated herein by reference.

TECHNICAL FIELD

This disclosure relates generally to cooling systems.

BACKGROUND

The statements in this section merely provide background information related to the present disclosure and may not constitute prior art.

Conventional two-phase pumped loops have been in existence since the 1980's as two-phase evaporative cooling units. However, the primary difference between the commercially available units is the cooling temperature at the evaporator. An apparatus, such as a high-energy laser (HEL), needs to be maintained at a constant temperature regardless of ambient temperature. However, the commercially available units allow the evaporator temperature to change with ambient temperature.

DRAWINGS

In order that the disclosure may be well understood, there will now be described various forms thereof, given by way of example, reference being made to the accompanying drawings, in which.

Figure 1:
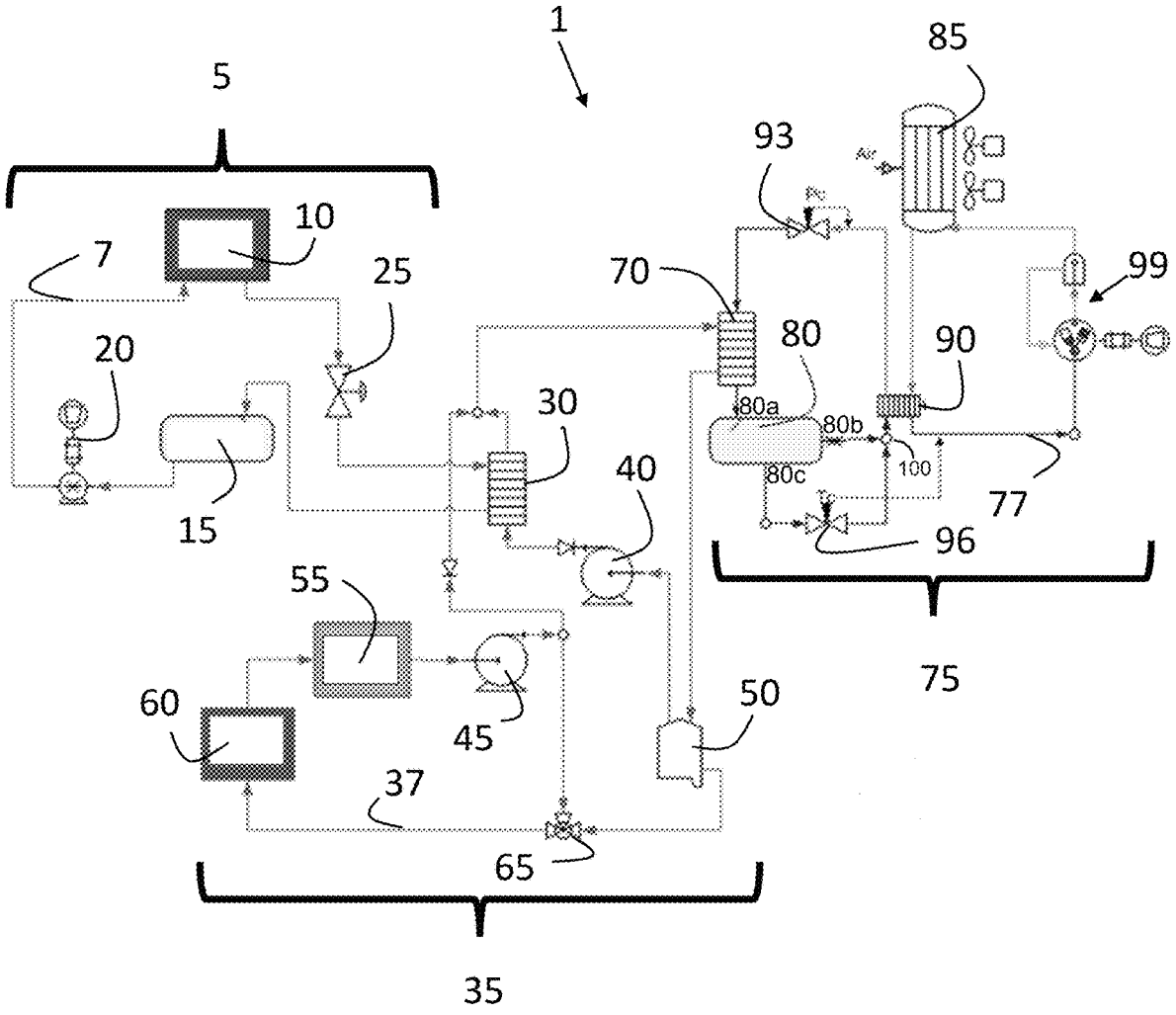
FIG. 1 is a schematic representation of a thermal management system (TMS) constructed according to the teachings of the present disclosure.

The drawings described herein are for illustration purposes only and are not intended to limit the scope of the present disclosure in any way.

DETAILED DESCRIPTION

The present disclosure generally provides a thermal management system (TMS) for regulating dissipation of multiple thermal loads during operation of an apparatus. The TMS of the present disclosure allows for heat dissipation or rejection of multiple thermal loads that may arise in many applications involving an apparatus operated with high energy consumption. The TMS generally comprises a two-phase pump loop (TPPL), a thermal energy storage (TES) system, and a vapor cycle system (VCS) integrated together to maintain the apparatus at a constant temperature. The TPPL is configured to remove heat or transfer the thermal load from the apparatus to the TES system. The TES system is an intermediate heat transfer loop that provides the following functions: transmission of heat from TPPL to VCS; absorption of one or more thermal loads; transmission of heat from the thermal loads to the VCS; thermal energy storage, and/or temperature regulation of coolant to compensate for at least one thermal load.

The heat arising during the operation of the apparatus may be transient or steady state and transferred into the thermal management system (TMS), by any means known in the art, including but not limited to, using a TPPL, a fluid or fluid mixture system, or an air conditioning system in conjunction with any type of fluid, coolant, or refrigerant. The thermal loads dissipated by the TMS may be at different temperatures with the TES system constrained not to exceed the minimum of these temperatures. Generally, the thermal loads may include a primary thermal load in the form of heat arising from the apparatus and a secondary thermal load in the form of at least one of a housekeeping thermal load which may be required to operate the apparatus and/or platform thermal loads, and/or thermal loads associated with conditioning, distributing, or converting energy. The thermal loads associated with conditioning, distributing, or converting energy may include but not be limited to thermal loads associated with power electronics.

The design of the TMS allows for control of the fluid or fluid mixture temperature, the flow of the fluid or fluid mixture, or both depending upon the requirements of the application. The design also provides thermal energy storage, such that the system may be a practical, operable, and package-able solution when an application requires the use of a TPPL to remove heat from a high-energy system and has one or more housekeeping loads that use a different fluid and/or are at a different temperature.

The following description is merely exemplary in nature and is in no way intended to limit the present disclosure or its application or uses. For example, the thermal management system made and used according to the teachings contained herein is described throughout the present disclosure in conjunction with cooling a high-energy laser (HEL) in order to more fully illustrate the composition and the use thereof. The incorporation and use of such a thermal management system in other industrial and military applications that may include any apparatus, device, or combination of apparatuses or devices that consume electricity and may benefit from cooling and/or heating are contemplated to be within the scope of the present disclosure. Several examples of such an apparatus or device includes, without limitation, solid state electronics, a light-emitting diode (LED), an analog circuit, a digital circuit, a computer, a server, a server farm, a data center, a hoteling circuit such as vehicle electronics, a vehicle, an aircraft, a directed-energy weapon, a laser, a plasma weapon, a railgun, a microwave generator, a pulse-powered device, a satellite uplink, an electric motor, an electric device, or the like.

For the purpose of this disclosure the terms "about" and "substantially" are used herein with respect to measurable values and ranges due to expected variations known to those skilled in the art (e.g., limitations and variability in measurements).

For the purpose of this disclosure, the terms "at least one" and "one or more of" an element are used interchangeably and may have the same meaning. These terms, which refer to the inclusion of a single element or a plurality of the elements, may also be represented by the suffix "(s)" at the end of the element. For example, "at least one source", "one or more sources", and "source(s)" may be used interchangeably and are intended to have the same meaning.

For the purpose of this disclosure, the term "constant" temperature describes a temperature condition that is stable and exhibits minimal variation, such as ±5° C.; alternatively, ±3° C.; alternatively, ±1° C.; alternatively, ±0.5° C. When desirable this variation in temperature may also be expressed as a percentage of the measured temperature. For example, as the measured temperature ±10%; alternatively, ±5%; alternatively, ±2.5%; alternatively, ±1.25%.

For purposes of promoting an understanding of the principles of the present disclosure, reference will now be made to the embodiments illustrated in the drawings, and specific language will be used to describe the same. It should be understood that throughout the description, corresponding reference numerals indicate like or corresponding parts and features. One skilled in the art will further understand that any properties reported herein represent properties that are routinely measured and may be obtained by multiple different methods. The methods described herein represent one such method and other methods may be utilized without exceeding the scope of the present disclosure.

No limitation of the scope of the present disclosure is intended by the illustration and description of certain embodiments herein. In addition, any alterations and/or modifications of the illustrated and/or described embodiment(s) are contemplated as being within the scope of the present disclosure. Further, any other applications of the principles of the present disclosure, as illustrated and/or described herein, as would normally occur to one skilled in the art to which the disclosure pertains, are contemplated as being within the scope thereof.

Referring to FIG. 1, a thermal management system 1 is shown that comprises a two-phase pump loop (TPPL) 5, a vapor cycle system (VCS) 75, and a thermal energy storage (TES) system 35. The various components within each of the TPPL 5, VCS 75, and TES system 35 may be in fluid communication via tubing, hose, or lines through which the corresponding fluid, fluid or fluid mixture, or coolant flows.

The TTPL 5 may be formed of a fluid loop configured to cool the primary thermal load. This fluid loop 5 comprises, consists of, or consists essentially of a fluid 7, a back pressure regulator 25, an evaporator 10, and a condenser 30 that is thermally coupled to the TES system 35. The back pressure regulator 25 is configured to manage or control pressure, and thus temperature at an exit of the evaporator in the TPPL 5. The evaporator 10 is configured to absorb heat from the apparatus at a near constant temperature. The heat, which is absorbed by the fluid 7 at the evaporator 10, is removed from the TPPL 5 at the condenser 30. This heat is transferred into a fluid or fluid mixture 37 associated with the TES system 35, solving several of the stated problems for a conventional two-phase pump loop. The TPPL 5 may also comprise a pump 20 configured to cause the fluid 7 to flow through the TPPL 5 and an accumulator 15 to prevent any back flow of the fluid 7 into the condenser 30. A further description of various structures, elements, and the performance associated with a TPPL is provided in a co-pending application entitled "Tight Temperature Control at a Thermal Load with a Two-Phase Pumped Loop, Optionally Augmented with a Vapor Compression Cycle" filed herewith that claims priority to U.S. Provisional Application No. 62/656,491 filed Apr. 12, 2018, the entire contents of which are hereby incorporated by reference.

The fluid 7 in the TPPL 5 may be any substance suitable for use in a two-phase pump loop (TPPL) 5. In other words, the fluid 7 may be any substance having a vapor to fluid transition. The fluid 7 may, without limitation, be suitable for use in a coolant and/or refrigeration system. Several examples of a fluid 7 may include, but not be limited to, a chlorofluorocarbon (CFC), a hydrochlorofluorocarbon (HCFC), a hydrofluorocarbon (HFC), difluoromethane, difluoroethane, or a combination thereof. When desirable, the fluid may be R134a, ammonia, carbon dioxide ($CO_2$) or a sub-critical, trans-critical, or super-critical coolant system.

The fluid or fluid mixture 37 of the TES system 35 provides for thermal energy storage, as well as thermal damping by allowing a high flow capacity pump 40 to change speed and provide cooling from flowing a fluid or fluid mixture 37 from a TES reservoir 50 very quickly.

Still referring to FIG. 1, the VCS 75 comprises a coolant loop that includes an evaporator 70 thermally coupled with the TES system 35 in order to transfer heat from the TES system 35 to the VSC 75; a coolant 77; a vapor-liquid separator 80 having an inlet 80*a*, a vapor outlet 80*b*, and a liquid outlet 80*c*; and a liquid return valve 96 configured to adjust the flow of the coolant 77 based on the temperature of the coolant 77. The VSC 75 further comprises a recuperator 90 having a high pressure and low pressure side that is configured to transfer heat from the high pressure side to the low pressure side; a compressor 99 configured to compress the coolant 77 supplied to the compressor 99 in a vapor state; a gas cooler 85 configured to cool the coolant 77 compressed by the compressor 99; and an expansion valve 93 configured to adjust the flow of the coolant based on pressure in the VCS 75.

The vapor outlet 80*b* of the vapor-liquid separator 80 includes a means of creating a pressure drop and a means for mixing a controlled amount of liquid from the liquid outlet 80*c* with vapor from the vapor outlet. Several examples of a means for creating a pressure drop include, without limitation, a restriction, a length of pipe or tubing, a pipe or a tubing having a cross-sectional area change, a pipe or a tubing including an obstruction, an orifice, a valve, a bent pipe, an automated valve, a venturi valve, and/or any other physical structure that causes a pressure drop on a fluid as the fluid flows through the physical structure. As shown in FIG. 1, the means for mixing may be a junction 100 where the pipe or tubing containing the liquid intersects with the pipe or tubing containing the vapor.

The vapor-liquid separator 80 may include any device configured to separate a vapor-liquid mixture into vapor and liquid portions. The vapor-liquid separator 80 may be a vessel in which gravity causes the liquid portion to settle to a bottom portion of the vessel and the vapor portion to rise to a top portion of the vessel. Alternatively, the vapor-liquid separator 80 may use centrifugal force to drive the liquid portion towards an outer edge of the vessel for removal and the vapor portion may migrate towards a center region of the vessel. In some examples, the vapor-liquid separator 80 may include a level sensor mechanism that monitors a level of the liquid in the vessel. Examples of the vapor-liquid separator may include, without limitation, a low pressure receiver and a flash tank.

The compressor 99 may be any mechanical device that increases a pressure of a gas by reducing the volume of the gas. This compressor 99 may be used in conjunction with an oil separator when desirable. Examples of the compressor 99 may include but not be limited to any gas compressor, such as a positive displacement compressor, a dynamic compressor, a rotary compressor, a reciprocating compressor, a centrifugal compressor, an axial compressor, and/or any combination thereof.

The coolant 77 may be any substance suitable for use in a vapor cycle system (VCS) 75. In other words, the coolant 77 may be any substance suitable for a trans-critical cooling system, super-critical cooling system, and/or a sub-critical cooling system. Examples of the coolant may include, without limitation, carbon dioxide ($CO_2$), anhydrous ammonia, a halomethane, a haloalkane, a hydrofluorocarbon (HFC), chlorofluorocarbons (CFC), a hydrochlorofluorocarbon (HCFC), any two-phase fluids, and/or a nanofluid.

During operation of the VCS 75, the compressor 99 may compress the coolant 77, which is supplied to the compressor 99 in a vapor state. The coolant 77 compressed by the compressor 99 may flow to the gas cooler 85. The gas cooler 85 may cool the coolant 77 compressed by the compressor 99. This cooled coolant 77 subsequently may flow to a recuperator 90, which has a high pressure and low pressure side. The recuperator 90 may include a heat exchanger that transfers heat from the coolant 77 on the high pressure side to the coolant 77 on the low pressure side.

As a result of the recuperator 90 transferring thermal energy from the high pressure side to the low pressure side, the coolant 77 that exits the gas cooler 85 may be cooled or sub-cooled prior to entering the expansion valve 93. The coolant 77 then enters the evaporator 70 wherein the coolant 77 absorbs heat from the TES system 35. The coolant 77 that exits the evaporator 70 flows into an inlet of the vapor-liquid separator 80. The coolant separates into a liquid and a vapor in the vapor-liquid separator 80. The vapor-liquid separator 80 includes both a liquid outlet and a vapor outlet with an inlet of the liquid return valve 96 receiving a portion of the coolant through the liquid outlet.

The vapor cycle system (VCS) 75 absorbs heat from the TES system 35 and dissipates the heat to air as quickly as it can upon initiation or start-up. The VSC 75 will continue to remove heat commensurate with the rated capacity as long as a thermal load is applied. The housekeeping thermal load 60 and the one or more thermal loads associated with conditioning, distributing, or converting energy 55 are transferred directly to the fluid or fluid mixture 37 of the TES system at the correct temperature set by the mixing valve 65, and sent to the VCS to be removed. If the housekeeping 60 and one or more other thermal loads 55 are large enough, the VCS 75 can be turned down to manage them continuously. If not, the TES reservoir 50 absorbs the heat load until the required temperature can no longer be delivered and the VCS 75 must cycle on to cool the TES system 35. In this configuration, the lower the temperature of the TES reservoir 50, the longer the VCS 75 will have between cycles for a given heat load. According to this aspect of the thermal management system 1, the fluid or fluid mixture 77 effluent from the condenser 30 in the TES system 35 is mixed with the overflow from cooling the housekeeping 60 and one or more thermal loads 55 associated with conditioning, distributing, or converting energy and sent to the VCS 75 to be cooled.

Referring once again to FIG. 1, the TES system 35 comprises a condenser 30 thermally coupled to the TPPL 5 that is configured to transfer heat from the TPPL 5 to the TES system 35. The TES system 35 further comprises a fluid or fluid mixture 37 that flows throughout the TES system 35. The TES system 35 also comprises a thermal energy storage (TES) reservoir 50 configured to contain a portion of the fluid or fluid mixture 37; a high capacity pump 40, and an evaporator 70. The pump 40 is configured to draw a portion of the fluid or fluid mixture 47 from the thermal energy storage reservoir 50 in order to provide thermal damping or cooling across the condenser 30. The evaporator 70, which is thermally coupled to the VCS 75, is configured to transfer heat from the TES system 35 to the VCS 75.

The fluid or fluid mixture 37 may comprise, but not be limited to, a mixture of water with any fluid that is soluble, dispersible, or miscible with the water. Several examples of such a fluid or fluid mixture, includes but are not limited to, water-ethylene glycol (EGW), water-propylene glycol (PGW), water-glycerol, and water-alcohol. Alternatively, the fluid or fluid mixture is a mixture of water and propylene glycol (PGW).

When desirable, the TES system 35 may further comprise one or more sources of at least one of the housekeeping thermal load 60 or the one or more thermal loads 55 associated with conditioning, distributing, or converting energy, as well as a second pump 45 and a mixing valve 65 coupled to the TES reservoir 50 and a second pump outlet flow. The second pump 45 has a lower flow capacity than the first pump 40. This second pump 45 is configured to draw a portion of the fluid or fluid mixture 37 from the TES reservoir 50 to provide cooling by the transfer of at least one of the housekeeping 60 or the one or more thermal loads 55 associated with conditioning, distributing, or converting energy into the fluid or fluid mixture 37. In addition, the mixing valve 65 is configured to control or regulate temperature by mixing the fluid or fluid mixture 37 drawn by the second pump 45 from the TES reservoir 50 with a portion of the fluid or fluid mixture 37 in which the at least one of the housekeeping 60 or the one or more thermal loads 55 associated with conditioning, distributing, or converting energy have been transferred. A portion of the fluid or fluid mixture 37 after transfer of the thermal load from at least one of the housekeeping 60 and the one or more thermal loads 55 associated with conditioning, distributing, or converting energy is mixed with a portion of the fluid or fluid mixture 37 in which the heat from the TPPL 5 at the condenser 30 has been transferred with the combined portions of the fluid or fluid mixture 37 being sent to the evaporator 70 that is thermally coupled to the VCS 75.

Figure 2:
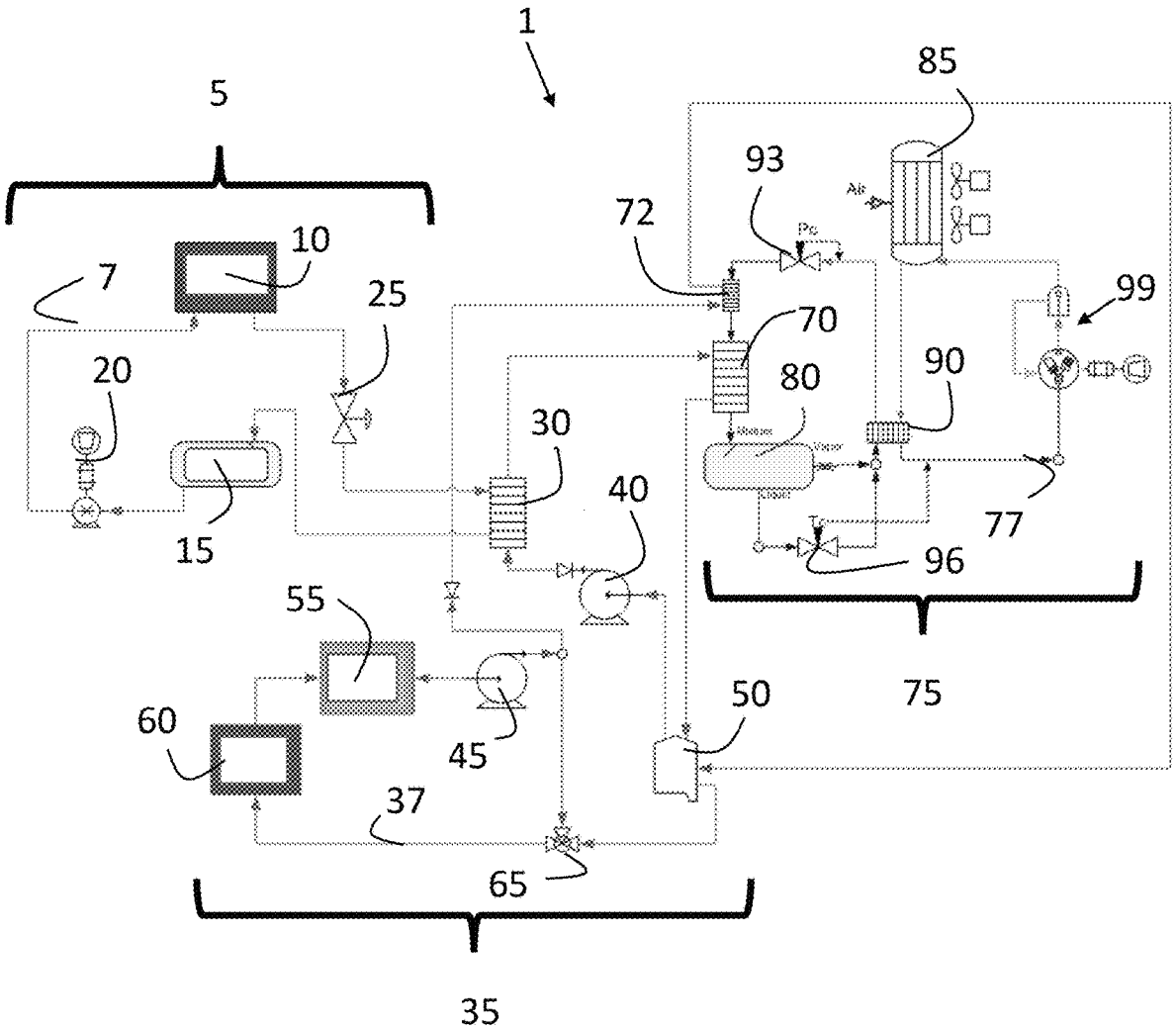
FIG. 2 is a schematic representation of another thermal management system (TMS) in which primary and secondary thermal loads are separated.

Referring now to FIG. 2, the VCS 75 may comprise a second evaporator 72 that is thermally coupled to the TES system 35. In this case, the TES system 35 separates the effluent from the secondary thermal load, e.g., HEL housekeeping 60 and/or thermal loads 55 associated with conditioning, distributing, or converting energy, from the primary thermal load transferred from the TPPL 5 through the condenser 30 to the TES system 35. The TES system 35 sends the primary and secondary heat loads to the VCS 75 through separate evaporators 70, 72, respectively. This may be beneficial when the VCS system is optimized to manage the secondary lower heat load condition and a significant difference in coolant temperatures exists between the apparatus (e.g., high-energy laser, HEL) and the housekeeping/conditioning/distributing/energy-converting thermal loads.

Figure 3:
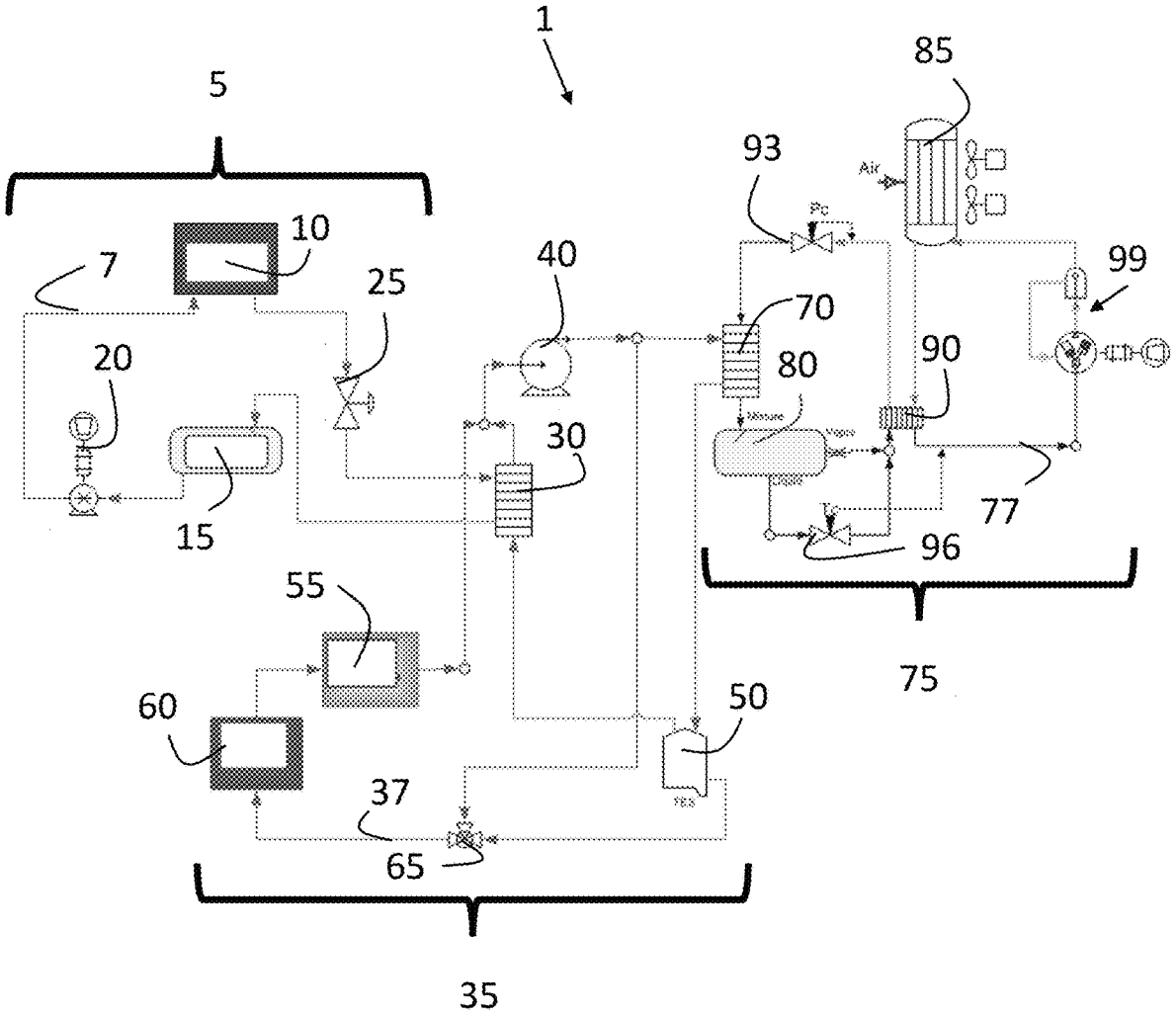
FIG. 3 is another schematic representation of the TMS of FIG. 1 in which the number of pumps in the Thermal Energy Storage (TES) system is reduced.

Referring now to FIG. 3, the number of pumps in the TES system 35 may be reduced to a single pump 40 when desirable. This represents a reduction from two (2) pumps 40, 45 in the TES system 35 as shown in FIG. 1 to one (1)

pump 40. In this embodiment, the overall footprint or size of the thermal energy storage (TES) system may be reduced.

Figure 4:
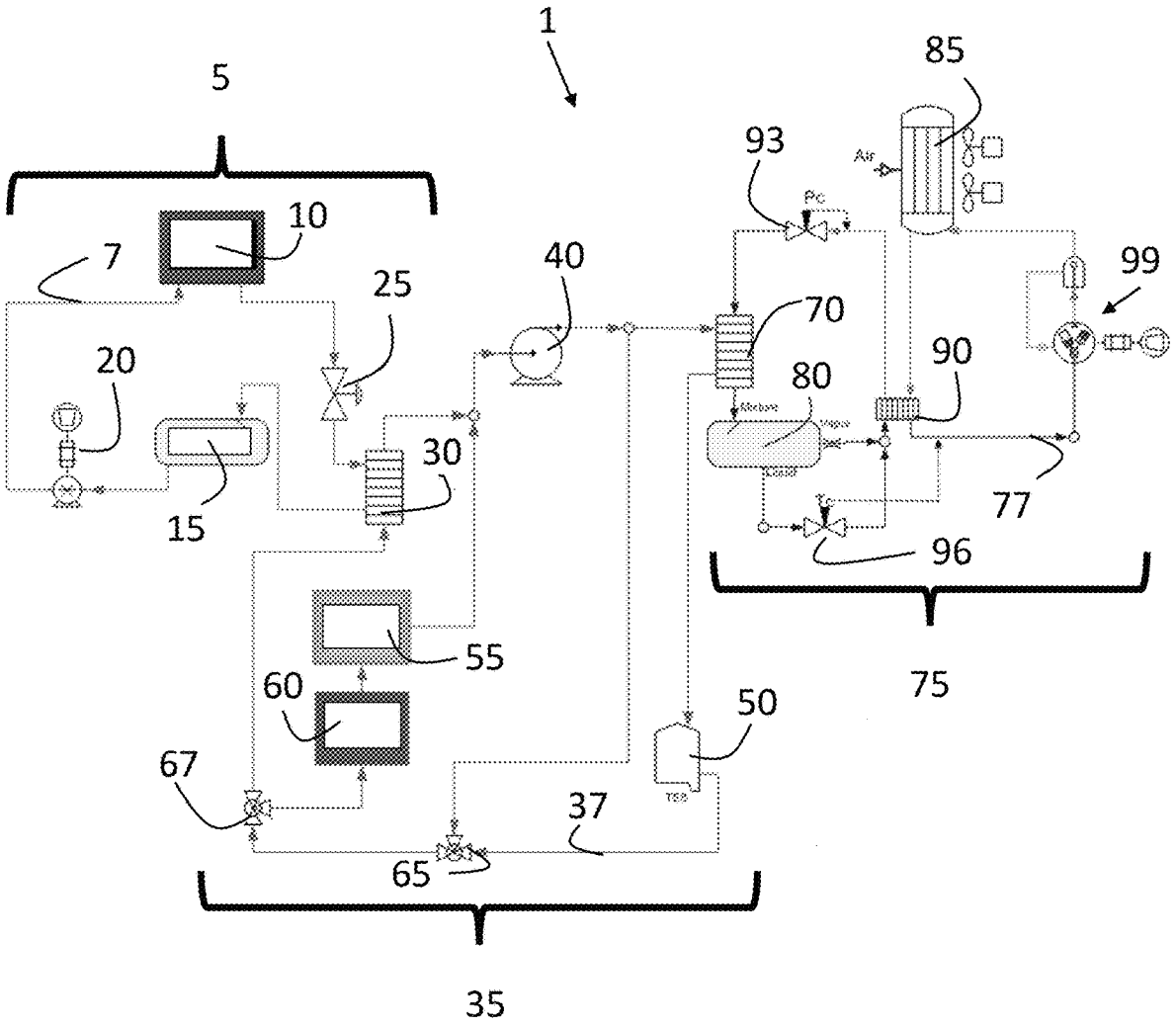
FIG. 4 is another schematic representation of the TMS of FIG. 3 in which a by-pass valve is configured to manage the flow of a fluid or fluid mixture through the condenser and the housekeeping or thermal loads associated with conditioning, distributing, or converting energy.

Referring now to FIG. 4, the one (1) pump 40 configuration may be further modified to comprise a by-pass valve 67 located prior to the condenser 30 and the housekeeping 60 and/or one or more thermal loads 55 associated with conditioning, distributing, or converting energy. This by-pass valve 67 may be configured to manage the flow of the fluid or fluid mixture 37 through the condenser 30 and the housekeeping/power electronics loads 60, 55. The benefit of this configuration resides in that the return temperature to the evaporator 70 thermally coupled to the VCS 75 will be higher and require a smaller heat exchanger and/or less power to run the VCS 75.

One skilled in the art will understand that the evaporator 70 used in conjunction with the VCS 75 may be made smaller by selecting appropriate materials for its construction without exceeding the scope of the present disclosure. More specifically, the important features of this evaporator 70 include the ability to transfer heat, the evacuation of any evaporated liquid, and the containment of pressure. A diffusion-bonded structure, such as applied to the design and construction of turbine airfoils may be used to form the evaporator 70. A diffusion-bonded structure includes complex heat transfer and fluid flow passages. The rules, tools, and manufacturing techniques employed in designing actively cooled turbines directly applies to the problem of providing for the cooling of an apparatus—with the addition of two-phase heat transfer and pressure drop calculations.

The thermal energy storage (TES) system 35 of the present disclosure may be configured to deliver a uniform pressure (and resulting temperature) to the evaporator 70. A control system that monitors and controls one or more aspects of the thermal management system 1, including but not limited to, pump speed, valve setting, VCS compressor speed, gas cooler fan speed, liquid pump speed, high side pressure, and superheat delivered to VCS compressor is envisioned to be included in the scope of the present disclosure.

Figure 5:
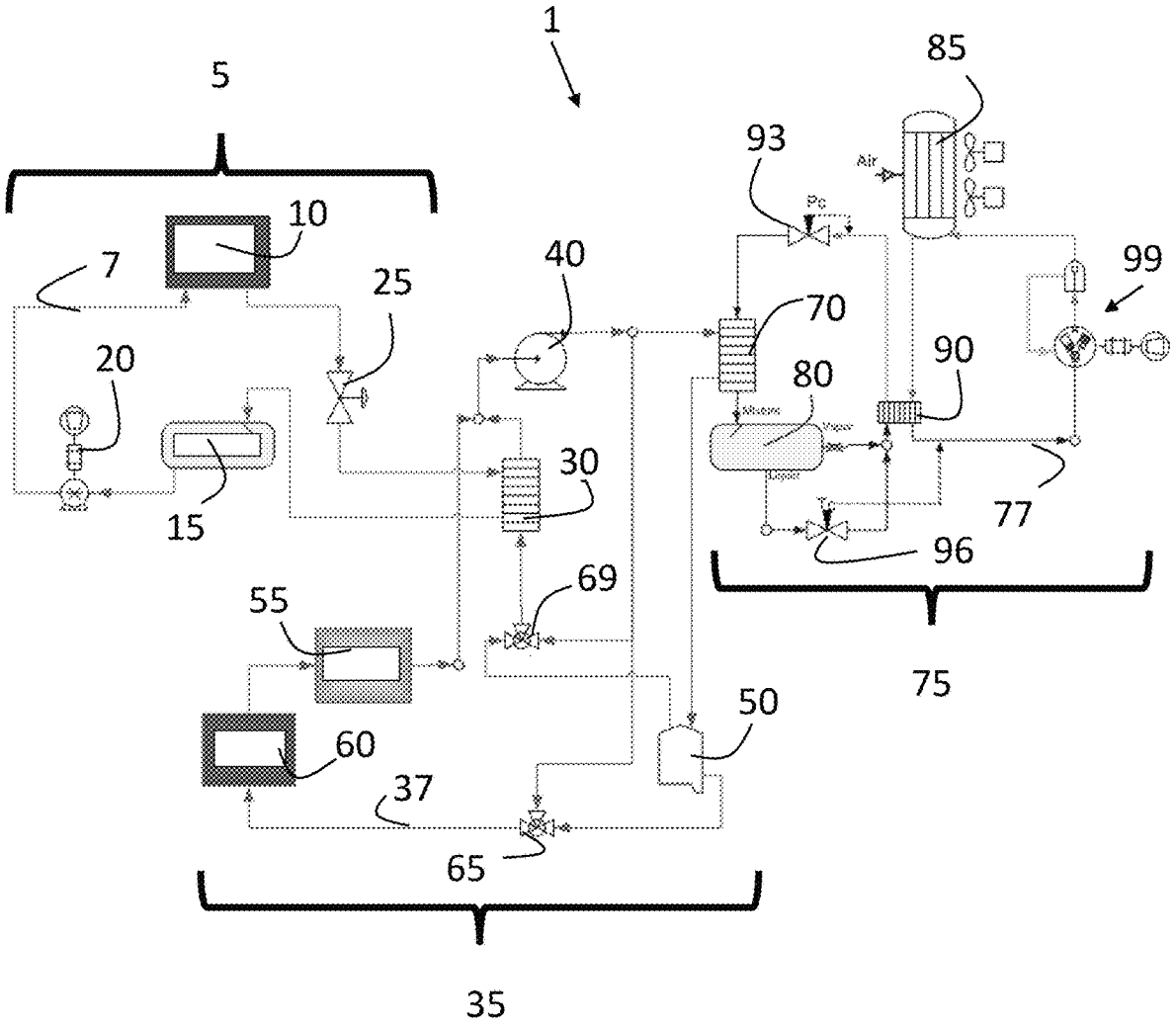
FIG. 5 is another schematic representation of the TMS of FIG. 3 in which a mixing valve is controlled to allow more of the fluid or fluid mixture to flow through the condenser without overcooling the TPPL.

Referring now to FIG. 5, a mixing valve 69 may be incorporated into the TES system 35 that has a single pump 40 as previously shown in FIG. 3. This mixing valve 69 may be located prior to the condenser 30 and after the TES reservoir 50. The mixing valve 69 may be in communication with the TES reservoir 50 and a pump outlet flow The incorporation of this mixing valve 69 into the TES system 35 allows for the inlet temperature to the condenser 30 to be at a higher temperature and therefore more fluid or fluid mixture 37 can flow through the condenser 70 without overcooling the TPPL 5. The incorporation of a mixing valve 69 into the TES system 35 is useful when the pump 40 needs to operate at a lower speed. Alternatively, this mixing valve 69 provides a means of quickly controlling the amount of cooling in the TPPL 5 without having to reduce the speed of the pump. When a sudden load increase or decrease occurs in the TPPL 5, the temperature set point associated with the mixing valve 69 can be changed.

Figure 6:
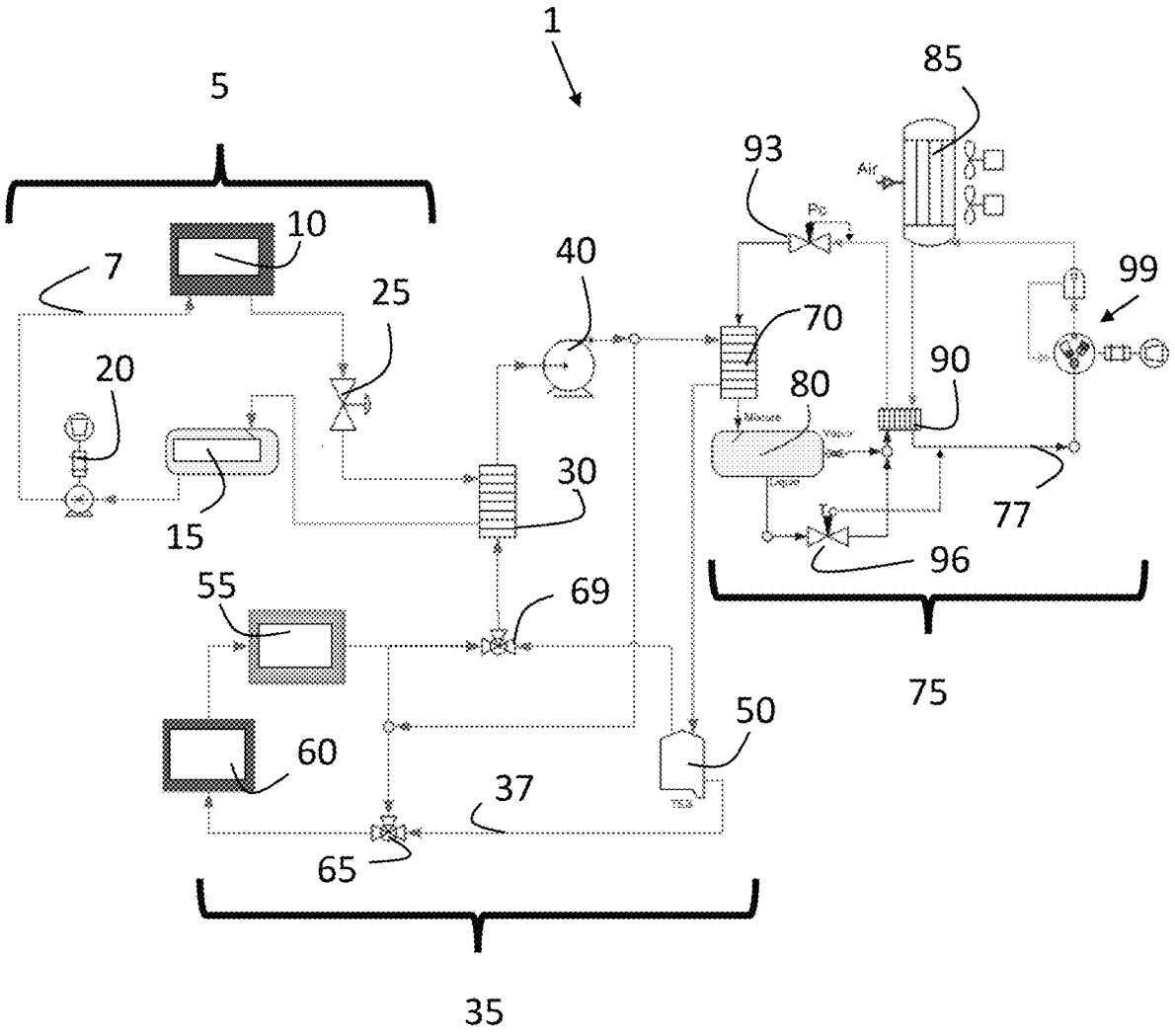
FIG. 6 is another schematic representation of the TMS of FIG. 5 in which the primary and secondary thermal loads are placed in series.

Referring now to FIG. 6 the primary heat load transferred from the TPPL 5 to the TES system 35 across the condenser 30 and the secondary heat loads 60, 55 may be placed in series. By placing the primary and secondary heat loads in series, the amount of the fluid or fluid mixture 37 that needs to flow through the TES system 35 is reduced. The end-result of this configuration is that a smaller evaporator 70 thermally coupled with the VCS 75, a smaller pump 40, and/or a smaller diameter pipe or line through which the fluid or fluid mixture 37 flows may be incorporated into the TES system 35. The temperature set point associated with the mixing valve 69 should not be set so low that the flow of the fluid or fluid mixture 37 going through the housekeeping 60 thermal load and the one or more thermal loads 55 associated with conditioning, distributing, or converting energy falls below a predetermined minimum or lower limit.

Figure 7:
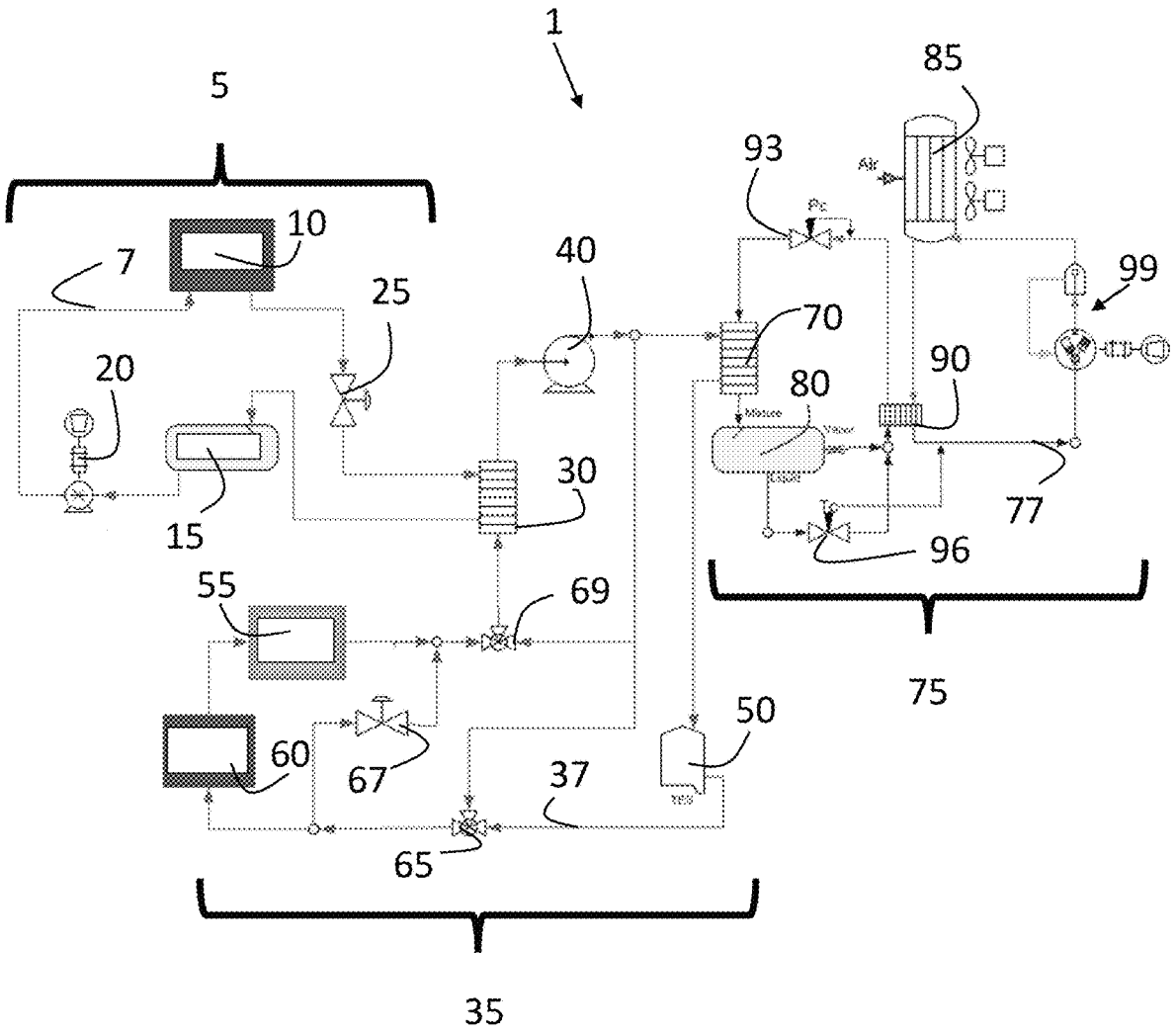
FIG. 7 is another schematic representation of the TMS of FIG. 6 with the by-pass valve of FIG. 4 incorporated therein.

Referring now to FIG. 7, the TES system 35 as shown in FIG. 6 may further comprise a by-pass valve 67 as previously described in FIG. 4. In this embodiment, the fluid or fluid mixture 37 that absorbs the housekeeping 60 and the one or more thermal loads 55 associated with conditioning, distributing, or converting energy may be used as the "cold" input to the second mixing valve 69. The by-pass valve 67 ensures that this portion of the TES system 35 remains cold enough to use as the cold input. In order to complete this task, the pump 40 operates at a variable speed in order to maintain the right temperature within the high and low extremes. The end-result associated with this scenario is a reduction in the overall need for thermal energy storage over an extended period of operation.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

The subject-matter of the disclosure may also relate, among others, to the following Aspects:

1. A thermal management system for regulating dissipation of multiple thermal loads during operation of an apparatus, the thermal management system comprising a two-phase pump loop (TPPL), a vapor cycle system (VCS), and a thermal energy storage (TES) system;

wherein the TPPL, the VCS, and the TES system are integrated together to maintain the apparatus at a constant temperature, the TPPL is configured to remove heat from the apparatus, the TES system is configured to provide thermal energy storage for some or all of the multiple thermal loads and temperature regulation at least one of the multiple thermal loads, and the VCS is configured to transfer heat to the environment;

wherein the multiple thermal loads comprise a primary thermal load in the form of heat from the apparatus and a secondary thermal load in the form of at least one of a housekeeping thermal load or one or more thermal loads associated with conditioning, distributing, or converting energy;

wherein the primary and secondary loads are at different temperatures with each being independently selected to be transient or steady state.
2. The thermal management system of Aspect 1, wherein the TPPL comprises a fluid loop configured to provide cooling of the primary thermal load, the fluid loop comprising a fluid; a back pressure regulator configured to control pressure and temperature at an exit in an evaporator in the TPPL; the evaporator configured to absorb heat from the apparatus at a near constant temperature; and a condenser thermally coupled to the TES system, the condenser configured to transfer heat from the TPPL to the TES system.
3. The thermal management system of any of Aspects 1 or 2, wherein the VCS comprises a coolant loop, the coolant loop comprising an evaporator thermally coupled with the TES system to transfer heat from the TES system to the VSC; a coolant; a vapor-liquid separator having an inlet, a vapor outlet, and a liquid outlet; a liquid return valve configured to adjust the flow of the coolant based on the temperature of the coolant; a recuperator having a high pressure and low pressure side that is configured to transfer heat from the high pressure side to the low pressure side; a compressor configured to compress the coolant supplied to the compressor in a vapor state; a gas cooler configured to cool the coolant compressed by the compressor; and an expansion valve configured to maintain the pressure upstream of the expansion valve;

wherein the vapor outlet of the vapor-liquid separator includes a means of creating a pressure drop and for mixing a controlled amount of liquid from the liquid outlet with vapor from the vapor outlet.

4. The thermal management system of any of Aspects 1-3, wherein the TES system comprises:

a condenser thermally coupled to the TPPL that is configured to transfer heat from the TPPL to the TES system;

a fluid or fluid mixture that flows throughout the TES system;

a thermal energy storage (TES) reservoir configured to contain a portion of the fluid or fluid mixture;

a pump controlled to draw a portion of the fluid or fluid mixture from the thermal energy storage in order to provide thermal damping or cooling across the condenser; and an evaporator thermally coupled to the VCS that is configured to transfer heat from the TES system to the VCS.

5. The thermal management system according to Aspect 4, wherein the TES system further comprises:

one or more sources of at least one of the housekeeping thermal load or the thermal loads associated with conditioning, distributing, or converting energy;

a second pump, the second pump having a lower flow capacity than the first pump, the second pump controlled to flow the desired flow rate through the housekeeping thermal load or the thermal loads associated with conditioning, distributing, or converting energy in order to provide cooling by the transfer of at least one of the housekeeping thermal load or the thermal loads associated with conditioning, distributing, or converting energy into the fluid or fluid mixture; and a mixing valve coupled to the TES reservoir and a second pump outlet flow, the mixing valve controlled to regulate temperature by mixing the fluid or fluid mixture drawn by the second pump from the TES reservoir with a portion of the fluid or fluid mixture in which the at least one of the housekeeping or the power electronic loads have been transferred;

wherein a portion of the fluid or fluid mixture after transfer of the thermal load from the at least one of the housekeeping and power electronics is mixed with a portion of the fluid or fluid mixture in which the heat from the TPPL at the condenser has been transferred, with the combined portions of the fluid or fluid mixture being sent to the evaporator thermally coupled to the VCS.

6. The thermal management system according to Aspect 4, wherein the TES system further comprises:

one or more sources of the at least one of the housekeeping thermal load or the power electronics thermal load;

a second pump, the second pump having a lower flow capacity than the first pump, the second pump controlled to draw a portion of the fluid or fluid mixture from the TES reservoir to provide cooling by the transfer of the at least one of the housekeeping or the thermal loads associated with conditioning, distributing, or converting energy into the fluid or fluid mixture;

a mixing valve in fluid communication with the TES reservoir and a second pump outlet flow, the mixing valve configured to regulate temperature by mixing the fluid or fluid mixture drawn by the second pump from the TES reservoir with a portion of the fluid or fluid mixture in which the at least one of the housekeeping thermal load or the thermal loads associated with conditioning, distributing, or converting energy have been transferred; and a second evaporator thermally coupled to the VCS that is configured to transfer one or more housekeeping and power electronic thermal loads from the TES system to the VCS separate from the transfer of heat to the VCS at the evaporator from the portion of the water mixture in which the heat from the TPPL at the condenser has been transferred.

7. The thermal management system of any of Aspects 1-3, wherein the TES system comprises:

a condenser thermally coupled to the TPPL that is configured to transfer heat from the TPPL to the TES system;

a fluid or fluid mixture that flows throughout the TES system, wherein the fluid is soluble, dispersible, or miscible with the water;

a thermal energy storage (TES) reservoir configured to contain a portion of the fluid or fluid mixture;

one or more sources of the at least one of the housekeeping thermal load or the power electronics thermal load;

a pump controlled to draw a portion of the fluid or fluid mixture from the thermal energy storage in order to provide thermal damping or cooling across the condenser;

a mixing valve coupled to the TES reservoir and a pump outlet flow, the mixing valve controlled to regulate temperature by mixing a portion of the fluid or fluid mixture drawn by the pump from the TES reservoir with a portion of the fluid or fluid mixture at the exit of the pump; and an evaporator thermally coupled to the VCS that is configured to transfer heat from the TES system to the VCS;

wherein a portion of the fluid or fluid mixture after transfer of the thermal load from the at least one of the housekeeping thermal load or the thermal loads associated with conditioning, distributing, or converting energy is mixed with a portion of the fluid or fluid mixture in which the heat from the TPPL at the condenser has been transferred, with the combined portions of the fluid or fluid mixture being sent to the evaporator thermally coupled to the VCS.

8. The thermal management system according to Aspect 7, wherein the TES system further comprises a by-pass valve configured to control the flow of the fluid or fluid mixture through the high energy condenser and around the at least one of the housekeeping thermal load or the thermal loads associated with conditioning, distributing, or converting energy.

9. The thermal management system according to Aspect 7, wherein the TES system further comprises a second mixing valve, the second mixing valve being positioned prior to the condenser and configured to control the amount of cooling in the TPPL without having to adjust the speed of the pump.

10. The thermal management system according to Aspect 7, wherein the TES system further comprises a second mixing valve, the second mixing valve being positioned prior to the condenser and in a location that places the high energy thermal load in series with the one or more housekeeping thermal load or the thermal loads associated with conditioning, distributing, or converting energy.

11. The thermal management system according to Aspect 9, wherein the TES system further comprises a by-pass valve used to control the flow of the fluid or fluid mixture prior to the second mixing valve in order to ensure that the fluid or fluid mixture is not above a predetermined temperature after the one or more housekeeping thermal load or the thermal loads associated with conditioning, distributing, or converting energy are transferred into the fluid or fluid mixture;

wherein the pump operates at a variable speed in order to maintain the predetermined temperature.

12. The thermal management system according to Aspect 4, wherein the fluid in the TPPL and the coolant in the VCS are independently selected as R134a, ammonia, or transcritical $CO_2$, and the fluid or fluid mixture in the TES system is a mixture of water and ethylene glycol, propylene glycol, glycerol, or an alcohol.

13. The thermal management system according to any of Aspects 1-12, wherein the thermal load is variable and has a minimal temperature limit; wherein the TES system is constrained not to exceed the minimum temperature limit.

14. The thermal management system according to any of Aspects 1-13, wherein the apparatus is a light-emitting diode (LED), an analog circuit, a digital circuit, a computer, a server, a server farm, a data center, a hoteling circuit, a vehicle, an aircraft, a directed-energy weapon, a high energy laser (HEL), a plasma weapon, a railgun, a microwave generator, a pulse-powered device, a satellite uplink, or an electric motor.

15. A method of regulating dissipation of multiple thermal loads during operation of an apparatus, the method comprising:

providing a thermal management system comprising a two-phase pump loop (TPPL), a vapor cycle system (VCS), and a thermal energy storage (TES) system that are integrated to maintain the apparatus at a constant temperature;

removing heat from the apparatus by transferring it to the TPPL;

transferring heat from the TPPL to the TES system; the TES system providing thermal energy storage and temperature regulation for cooling the multiple thermal loads; the multiple thermal loads comprising a primary thermal load in the form of heat from the apparatus and a secondary thermal load in the form of at least one of a housekeeping thermal load or a thermal load associated with conditioning, distributing, or converting energy; wherein the primary and secondary loads are at different temperatures with each being independently selected to be transient or steady state;

transferring heat from the TES system to the VSC; and transferring heat from the VSC to the environment.

16. The method according to Aspect 15, wherein the apparatus is a light-emitting diode (LED), an analog circuit, a digital circuit, a computer, a server, a server farm, a data center, a hoteling circuit, a vehicle, an aircraft, a directed-energy weapon, a high energy laser (HEL), a plasma weapon, a railgun, a microwave generator, a pulse-powered device, a satellite uplink, or an electric motor.

17. A liquid thermal energy storage (TES) system integrated with a two-phase pump loop (TPPL) and a vapor cycle system (VCS) for regulating dissipation of multiple thermal loads during operation of an apparatus; the TES system comprising:

a condenser thermally coupled to the TPPL and configured to transfer heat from the TPPL to the TES system;

a fluid or fluid mixture that flows throughout the TES system;

a thermal energy storage (TES) reservoir configured to contain a portion of the fluid or fluid mixture;

a pump controlled to draw a portion of the fluid or fluid mixture from the thermal energy storage in order to provide thermal damping or cooling across the condenser; and an evaporator thermally coupled to the VCS that is configured to transfer heat from the TES system to the VCS;

wherein the TES system, the two-phase pump loop (TPPL), and the vapor cycle system (VCS) maintain the apparatus at a constant temperature, the TPPL is configured to remove heat from the apparatus, the TES system is configured to provide thermal energy storage and temperature regulation, and the VCS is configured to transfer heat to the environment;

wherein the multiple thermal loads comprise a primary thermal load in the form of heat from the apparatus and a secondary thermal load in the form of at least one of a housekeeping thermal load or a thermal load associated with conditioning, distributing, or converting energy; the primary and secondary loads being at different temperatures with each independently selected to be transient or steady state.

18. The TES system according to Aspect 17, wherein the TES system further comprises:

one or more sources of the at least one of the housekeeping thermal load or the thermal load associated with conditioning, distributing, or converting energy;

a second pump, the second pump having a lower flow capacity than the first pump, the second pump configured to draw a portion of the fluid or fluid mixture from the TES reservoir to provide cooling by the transfer of the at least one of the housekeeping or the thermal loads associated with conditioning, distributing, or converting energy into the fluid or fluid mixture; and a mixing valve coupled to the TES reservoir, the mixing valve configured to regulate temperature by mixing the fluid or fluid mixture drawn by the second pump from the TES reservoir with a portion of the fluid or fluid mixture in which the at least one of the housekeeping thermal load or the thermal load associated with conditioning, distributing, or converting energy have been transferred;

wherein a portion of the fluid or fluid mixture after transfer of the thermal load from the at least one of the housekeeping thermal load and thermal load associated with conditioning, distributing, or converting energy is mixed with a portion of the fluid or fluid mixture in which the heat from the TPPL at the condenser has been transferred, with the combined portions of the fluid or fluid mixture being sent to the evaporator thermally coupled to the VCS.

19. The TES system according to Aspect 17, wherein the TES system further comprises:

one or more sources of the at least one of the housekeeping thermal load or the thermal load associated with conditioning, distributing, or converting energy;

a second pump, the second pump having a lower flow capacity than the first pump, the second pump configured to draw a portion of the fluid or fluid mixture from the TES reservoir to provide cooling by the transfer of the at least one of the housekeeping or the thermal load associated with conditioning, distributing, or converting energy into the fluid or fluid mixture;

a mixing valve in fluid communication with the TES reservoir, the mixing valve configured to regulate temperature by mixing the fluid or fluid mixture drawn by the second pump from the TES reservoir with a portion of the fluid or fluid mixture in which the at least one of the housekeeping or the thermal load associated with conditioning, distributing, or converting energy have been transferred; and a second evaporator thermally coupled to the VCS that is configured to transfer the one or more housekeeping and power electronic thermal loads from the TES system to the VCS separate from the transfer of heat to the VCS at the evaporator from the portion of the water mixture in which the heat from the TPPL at the condenser has been transferred.

20. The TES system according to Aspect 17, wherein the TES system further comprises one or more sources of the at least one of the housekeeping thermal load or the thermal load associated with conditioning, distributing, or converting energy; and a mixing valve coupled to the TES reservoir, the mixing valve configured to regulate temperature by mixing a portion of the fluid or fluid mixture drawn by the pump from the TES reservoir with a portion of the fluid or fluid mixture in which the heat from the TPPL has been transferred at the condenser;

wherein a portion of the fluid or fluid mixture after transfer of the thermal load from the at least one of the housekeeping thermal load and thermal load associated with conditioning, distributing, or converting energy is mixed with a portion of the fluid or fluid mixture in which the heat from the TPPL at the condenser has been transferred, with the combined portions of the fluid or fluid mixture being sent to the evaporator thermally coupled to the VCS.

21. The TES system according to Aspect 20, wherein the TES system further comprises one selected from the group of a by-pass valve configured to control the flow of the fluid or fluid mixture through the high energy condenser and around the at least one of the housekeeping thermal load or thermal load associated with conditioning, distributing, or converting energy; a second mixing valve positioned prior to the condenser and configured to control the amount of cooling in the TPPL without having to adjust the speed of the pump; or a second mixing valve positioned prior to the condenser and in a location that places the high energy thermal load in series with the one or more housekeeping thermal load and thermal load associated with conditioning, distributing, or converting energy.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A thermal management system for regulating dissipation of multiple thermal loads during operation of an apparatus, the thermal management system comprising a two-phase pump loop (TPPL), a vapor cycle system (VCS), and a thermal energy storage (TES) system;

wherein the TPPL, the VCS, and the TES system are integrated together to maintain the apparatus at a constant temperature, the TPPL is configured to remove heat from the apparatus, the TES system is configured to provide thermal energy storage for some or all of the multiple thermal loads and temperature regulation to at least one of the multiple thermal loads, and the VCS is configured to transfer heat to the environment;

wherein the VCS comprises a coolant loop, the coolant loop comprising an evaporator thermally coupled with the TES system to transfer heat from the TES system to the VCS; a coolant; a vapor-liquid separator having an inlet, a vapor outlet, and a liquid outlet; a liquid return valve configured to adjust the flow of the coolant based on the temperature of the coolant; a recuperator having a high pressure and low pressure side that is configured to transfer heat from the high pressure side to the low pressure side; a compressor configured to compress the coolant supplied to the compressor in a vapor state; a gas cooler configured to cool the coolant compressed by the compressor; and an expansion valve configured to maintain the pressure upstream of the expansion valve;

wherein the vapor outlet of the vapor-liquid separator includes a means of creating a pressure drop and means for mixing a controlled amount of liquid from the liquid outlet with vapor from the vapor outlet;

wherein the multiple thermal loads comprise a primary thermal load in the form of heat from the apparatus and a secondary thermal load in the form of at least one of a housekeeping thermal load or one or more thermal loads associated with conditioning, distributing, or converting energy; and wherein the primary and secondary loads are at different temperatures with each being independently selected to be transient or steady state.

2. The thermal management system of claim 1, wherein the TPPL comprises a fluid loop configured to provide cooling of the primary thermal load, the fluid loop comprising a fluid; a back pressure regulator configured to control pressure and temperature at an exit in an evaporator in the TPPL; the evaporator configured to absorb heat from the apparatus at a near constant temperature; and a condenser thermally coupled to the TES system, the condenser configured to transfer heat from the TPPL to the TES system.

3. The thermal management system of claim 1, wherein the TES system comprises:

a condenser thermally coupled to the TPPL that is configured to transfer heat from the TPPL to the TES system;

a fluid or fluid mixture that flows throughout the TES system;

a thermal energy storage (TES) reservoir configured to contain a portion of the fluid or fluid mixture;

a pump controlled to draw a portion of the fluid or fluid mixture from the thermal energy storage in order to provide thermal damping or cooling across the condenser; and an evaporator thermally coupled to the VCS that is configured to transfer heat from the TES system to the VCS.

4. The thermal management system according to claim 3, wherein the TES system further comprises:

one or more sources of at least one of the housekeeping thermal load or the thermal loads associated with conditioning, distributing, or converting energy;

a second pump, the second pump controlled to flow a desired flow rate through the housekeeping thermal load or the thermal loads associated with conditioning, distributing, or converting energy in order for fluid or fluid mixture to provide cooling by the transfer of at least one of the housekeeping or the thermal loads associated with conditioning, distributing, or converting energy into the fluid or fluid mixture; and a mixing valve coupled to the TES reservoir and a second pump outlet flow, the mixing valve controlled to regulate temperature by mixing the fluid or fluid mixture drawn by the second pump from the TES reservoir with a portion of the fluid or fluid mixture in which the at least one of the housekeeping thermal load or the thermal loads associated with conditioning, distributing, or converting energy have been transferred;

wherein a portion of the fluid or fluid mixture after transfer of the thermal load from the at least one of the housekeeping thermal load or the thermal loads associated with conditioning, distributing, or converting energy is mixed with a portion of the fluid or fluid mixture in which the heat from the TPPL at the condenser has been transferred, with the combined portions of the fluid or fluid mixture being sent to the evaporator thermally coupled to the VCS.

5. The thermal management system according to claim 3, wherein the TES system further comprises:

one or more sources of the at least one of the housekeeping thermal load or the thermal loads associated with conditioning, distributing, or converting energy;

a second pump, the second pump having a lower flow capacity than the first pump, the second pump controlled to draw a portion of the fluid or fluid mixture from the TES reservoir to provide cooling by the transfer of at least one of the housekeeping or the thermal loads associated with conditioning, distributing, or converting energy into the fluid or fluid mixture;

a mixing valve in fluid communication with the TES reservoir and a second pump outlet flow, the mixing valve controlled to regulate temperature by mixing the fluid or fluid mixture drawn by the second pump from the TES reservoir with a portion of the fluid or fluid mixture in which the at least one of the housekeeping thermal load or the thermal loads associated with conditioning, distributing, or converting energy have been transferred; and a second evaporator thermally coupled to the VCS that is configured to transfer one or more of the housekeeping thermal load and the thermal loads associated with conditioning, distributing, or converting energy from the TES system to the VCS separate from the transfer of heat to the VCS at the evaporator from the portion of the water mixture in which the heat from the TPPL at the condenser has been transferred.

6. The thermal management system of claim 3, wherein the TES system further comprises:

one or more sources of the at least one of the housekeeping thermal load or the thermal loads associated with conditioning, distributing, or converting energy; and a mixing valve coupled to the TES reservoir and a pump outlet flow, the mixing valve controlled to regulate temperature by mixing a portion of the fluid or fluid mixture drawn by the pump from the TES reservoir with a portion of the fluid or fluid mixture at an exit of the pump; and wherein a portion of the fluid or fluid mixture after transfer of the thermal load from the at least one of the housekeeping thermal load or the thermal loads associated with conditioning, distributing, or converting energy is mixed with a portion of the fluid or fluid mixture in which the heat from the TPPL at the condenser has been transferred, with the combined portions of the fluid or fluid mixture being sent to the evaporator thermally coupled to the VCS.

7. The thermal management system according to claim 6, wherein the TES system further comprises a by-pass valve configured to control the flow of the fluid or fluid mixture through the condenser and around the at least one of the housekeeping thermal load or thermal load associated with conditioning, distributing, or converting energy.

8. The thermal management system according to claim 6, wherein the TES system further comprises a second mixing valve, the second mixing valve being positioned prior to the condenser and configured to control the amount of cooling in the TPPL without having to adjust the speed of the pump.

9. The thermal management system according to claim 8, wherein the TES system further comprises a by-pass valve used to control the flow of the fluid or fluid mixture prior to the second mixing valve in order to ensure that the fluid or fluid mixture is not above a predetermined temperature after the one or more housekeeping thermal load or thermal loads associated with conditioning, distributing, or converting energy are transferred into the fluid or fluid mixture;

wherein the pump operates at a variable speed in order to maintain the predetermined temperature.

10. The thermal management system according to claim 6, wherein the TES system further comprises a second mixing valve, the second mixing valve being positioned prior to the condenser and in a location that places the housekeeping thermal load in series with the thermal loads associated with conditioning, distributing, or converting energy.

11. The thermal management system according to claim 3, wherein the fluid in the TPPL and the coolant in the VCS are independently selected to be R134a, ammonia, or trans-critical CO2, and the fluid or fluid mixture in the TES system is a mixture of water and ethylene glycol, propylene glycol, glycerol, or an alcohol.

12. The thermal management system according to claim 1, wherein the thermal load is variable and has a minimal temperature limit;

wherein the TES system is constrained not to exceed the minimum temperature limit.

13. The thermal management system according to claim 1 wherein the apparatus is a light-emitting diode (LED), an analog circuit, a digital circuit, a computer, a server, a server farm, a data center, a hoteling circuit, a vehicle, an aircraft, a directed-energy weapon, a high energy laser (HEL), a plasma weapon, a railgun, a microwave generator, a pulse-powered device, a satellite uplink, or an electric motor.

14. A method of regulating dissipation of multiple thermal loads during operation of an apparatus, the method comprising:

providing a thermal management system comprising a two-phase pump loop (TPPL), a vapor cycle system (VCS), and a liquid thermal energy storage (TES) system that are integrated to maintain the apparatus at a constant temperature;

removing heat from the apparatus by transferring it to the TPPL;

transferring heat from the TPPL to the TES system; the TES system providing thermal energy storage and temperature regulation for cooling the multiple thermal loads; the multiple thermal loads comprising a primary thermal load in the form of heat from the apparatus and a secondary thermal load in the form of at least one of a housekeeping thermal load or a thermal load associated with conditioning, distributing, or converting energy; wherein the primary and secondary loads are at different temperatures with each being independently selected to be transient or steady state; and wherein the TES system comprises: a condenser thermally coupled to the TPPL and configured to transfer heat from the TPPL to the TES system; a fluid or fluid mixture that flows throughout the TES system, wherein the fluid is soluble, dispersible, or miscible with water; a thermal energy storage (TES) reservoir configured to contain a portion of the fluid or fluid mixture; a pump controlled to draw a portion of the fluid or fluid mixture from the thermal energy storage (TES) reservoir in order to provide thermal damping or cooling across the condenser; an evaporator thermally coupled to the VCS that is configured to transfer heat from the TES system to the VCS; and a mixing valve coupled to the TES reservoir, the mixing valve configured to regulate temperature by mixing a portion of the fluid or fluid mixture drawn by the pump from the TES reservoir with a portion of the fluid or fluid mixture in which the heat from the TPPL has been transferred at the condenser;

transferring heat from the TES system to the VSC, wherein a portion of the fluid or fluid mixture after transfer of the thermal load from the at least one of the housekeeping thermal load or the thermal load associated with conditioning, distributing, or converting energy is mixed with a portion of the fluid or fluid mixture in which the heat from the TPPL at the condenser has been transferred, with the combined portions of the fluid or fluid mixture being sent to the evaporator thermally coupled to the VCS; and transferring heat from the VSC to the environment.

15. The method according to claim 14, wherein the apparatus is a light-emitting diode (LED), an analog circuit, a digital circuit, a computer, a server, a server farm, a data center, a hoteling circuit, a vehicle, an aircraft, a directed-energy weapon, a high energy laser (HEL), a plasma weapon, a railgun, a microwave generator, a pulse-powered device, a satellite uplink, or an electric motor.

16. A liquid thermal energy storage (TES) system integrated with a two-phase pump loop (TPPL) and a vapor cycle system (VCS) for regulating dissipation of multiple thermal loads during operation of an apparatus; the TES system comprising:

a condenser thermally coupled to the TPPL and configured to transfer heat from the TPPL to the TES system;

a fluid or fluid mixture that flows throughout the TES system, wherein the fluid is soluble, dispersible, or miscible with water;

a thermal energy storage (TES) reservoir configured to contain a portion of the fluid or fluid mixture;

a pump controlled to draw a portion of the fluid or fluid mixture from the thermal energy storage (TES) reservoir in order to provide thermal damping or cooling across the condenser; and an evaporator thermally coupled to the VCS that is configured to transfer heat from the TES system to the VCS;

one or more sources of at least one of a housekeeping thermal load or a thermal load associated with conditioning, distributing, or converting energy; and a mixing valve coupled to the TES reservoir, the mixing valve configured to regulate temperature by mixing a portion of the fluid or fluid mixture drawn by the pump from the TES reservoir with a portion of the fluid or fluid mixture in which the heat from the TPPL has been transferred at the condenser;

wherein the TES system, the two-phase pump loop (TPPL), and the vapor cycle system (VCS) maintain the apparatus at a constant temperature, the TPPL is configured to remove heat from the apparatus, the TES system is configured to provide thermal energy storage and temperature regulation, and the VCS is configured to transfer heat to the environment;

wherein a portion of the fluid or fluid mixture after transfer of the thermal load from the at least one of the housekeeping thermal load or the thermal load associated with conditioning, distributing, or converting energy is mixed with a portion of the fluid or fluid mixture in which the heat from the TPPL at the condenser has been transferred, with the combined portions of the fluid or fluid mixture being sent to the evaporator thermally coupled to the VCS; and wherein the multiple thermal loads comprise a primary thermal load in the form of heat from the apparatus and a secondary thermal load in the form of the at least one of the housekeeping thermal load or the thermal load associated with conditioning, distributing, or converting energy; the primary and secondary loads being at different temperatures with each independently selected to be transient or steady state.

17. The TES system according to claim 16, wherein the TES system further comprises:

one or more sources of the at least one of the housekeeping thermal load or the thermal loads associated with conditioning, distributing, or converting energy;

a second pump, the second pump having a lower flow capacity than the first pump, the second pump configured to draw a portion of the fluid or fluid mixture from the TES reservoir to provide cooling by the transfer of the at least one of the housekeeping or the power electronics thermal loads into the fluid or fluid mixture; and a mixing valve coupled to the TES reservoir, the mixing valve configured to regulate temperature by mixing the fluid or fluid mixture drawn by the second pump from the TES reservoir with a portion of the fluid or fluid mixture in which the at least one of the housekeeping thermal load or the thermal loads associated with conditioning, distributing, or converting energy have been transferred, wherein a portion of the fluid or fluid mixture after transfer of the thermal load from the at least one of the housekeeping thermal load and the thermal loads associated with conditioning, distributing, or converting energy is mixed with a portion of the fluid or fluid mixture in which the heat from the TPPL at the condenser has been transferred, with the combined portions of the fluid or fluid mixture being sent to the evaporator thermally coupled to the VCS.

18. The TES system according to claim 16, wherein the TES system further comprises:

one or more sources of the at least one of the housekeeping thermal load or the thermal loads associated with conditioning, distributing, or converting energy;

a second pump, the second pump having a lower flow capacity than the first pump, the second pump controlled to draw a portion of the fluid or fluid mixture from the TES reservoir to provide cooling by the transfer of the at least one of the housekeeping or the thermal loads associated with conditioning, distributing, or converting energy into the fluid or fluid mixture;

a mixing valve in fluid communication with the TES reservoir, the mixing valve configured to regulate temperature by mixing the fluid or fluid mixture drawn by the second pump from the TES reservoir with a portion of the fluid or fluid mixture in which the at least one of the housekeeping thermal load or the thermal loads associated with conditioning, distributing, or converting energy have been transferred; and a second evaporator thermally coupled to the VCS that is configured to transfer the one or more housekeeping thermal load and thermal loads associated with conditioning, distributing, or converting energy from the TES system to the VCS separate from the transfer of heat to the VCS at the evaporator from the portion of the fluid or fluid mixture in which the heat from the TPPL at the condenser has been transferred.

19. The TES system according to claim 16, wherein the TES system further comprises one selected from the group of a by-pass valve configured to control the flow of the fluid or fluid mixture through the condenser and around the at least one of the housekeeping thermal load or thermal loads associated with conditioning, distributing, or converting energy; a second mixing valve positioned prior to the condenser and configured to control the amount of cooling in the TPPL without having to adjust a speed of the pump; or a second mixing valve positioned prior to the condenser and in a location that places the housekeeping thermal load in series with the thermal loads associated with conditioning, distributing, or converting energy.

* * * * *